US008601735B2

(12) United States Patent
Corsi et al.

(10) Patent No.: US 8,601,735 B2
(45) Date of Patent: Dec. 10, 2013

(54) SIDE LOCK ACTION FIREARM

(75) Inventors: Paul Joseph Corsi, Terryville, CT (US); Jonathon Dale Scott, Bristol, CT (US)

(73) Assignee: Connecticut Shotgun Manufacturing Company, New Britain, CT (US)

( * ) Notice: Subject to any disclaimer, the term of this patent is extended or adjusted under 35 U.S.C. 154(b) by 474 days.

(21) Appl. No.: 12/798,615

(22) Filed: Apr. 8, 2010

(65) Prior Publication Data

US 2011/0247253 A1 Oct. 13, 2011

(51) Int. Cl.
*F41A 21/00* (2006.01)

(52) U.S. Cl.
USPC ..... 42/75.03

(58) Field of Classification Search
USPC ..... 42/75.03, 75.01, 69.01
See application file for complete search history.

(56) References Cited

U.S. PATENT DOCUMENTS

| | | | | |
|---|---|---|---|---|
| 3,381,405 | A | 5/1968 | Edwards | |
| 3,739,515 | A * | 6/1973 | Koon, Jr. | 42/75.03 |
| 4,112,605 | A | 9/1978 | Staub | |
| 4,290,220 | A * | 9/1981 | Ruger | 42/75.04 |
| 7,886,473 | B2 * | 2/2011 | Rotharmel | 42/75.03 |
| 2003/0029070 | A1 * | 2/2003 | Dowding | 42/75.03 |
| 2009/0277067 | A1 | 11/2009 | Gregg | |
| 2010/0071246 | A1 * | 3/2010 | Vesligai | 42/75.03 |

* cited by examiner

*Primary Examiner* — J. Woodow Eldred
(74) *Attorney, Agent, or Firm* — Bennet K. Langlotz; Langlotz Patent & Trademark Works, Inc.

(57) ABSTRACT

A side lock action firearm has a frame with an attached side lock action. The frame includes a rearwardly protruding portion including a mating feature. A stock including a mating element is removably connected to the frame when the mating element is engaged with the mating feature. The mating feature may be a threaded boss. The mating element may be a draw bolt. A forward portion of the stock may be shaped to closely receive the rearwardly protruding portion of the frame. The stock may include a central bore, and the draw bolt may be received by the central bore in the stock.

11 Claims, 5 Drawing Sheets

SIDE LOCK ACTION FIREARM

FIELD OF THE INVENTION

The present invention relates to a side lock action firearm, and more particularly to a side lock action firearm with an improved stock mounting system.

BACKGROUND OF THE INVENTION

Conventionally, two different approaches have been used to attach a stock to the receiver of a shotgun. Each is associated with a type of action, which is the operating mechanism of the gun. The two types of actions are referred to as box lock and side lock.

The box lock action is a hammerless action commonly used in double barreled shotguns that dates back to 1875. The box lock action uses concealed, self-cocking hammers in a break-open action. A draw bolt opening within the stock receives the head of a draw bolt. The draw bolt is tightened to cause the stock to engage to the receiver and integrate the stock with the operative parts of the shotgun. An example of this approach, modified to reduce recoil, is found in U.S. Pat. No. 3,381,405 to Edwards. A sharp dividing line exists between the wooden stock and the metal, making this a typical consumer-level approach. Collectors of firearms do not like it because the appearance is bland.

The box lock action has two additional disadvantages: the hammer pin must be placed directly below the knee of the action, which is its weakest spot, and the action walls must be thinned out to receive locks. These are inserted from below into large slots in the action's body, which is then closed with a plate.

The side lock action is an expensive, high quality alternative to the box lock action. The moving parts of the action are located on side lock plates inletted in the stock. The side plates have holes that receive pins to mount the lock parts. The stock is deeply scalloped where it meets the action, with wood going over and under the side lock plates. The receiver has an upper and lower tang, which are portions of the receiver that extend rearwardly into the stock. Screws extend from the upper tang to the lower tang, compressing the stock between the tangs.

The side lock action is preferred by collectors because of its complexity and attractive appearance. However, the conventional side lock action also has drawbacks. The wooden stock can compress variably between the tangs, causing the flush fit between the tangs and the stock to be lost. The tang engagement screws also tend to back off over time, which causes the fit between the tangs and the stock to loosen. An imprecise fit between the stock and the tangs not only detracts from the shotgun's appearance, but may also compromise the stock's strength and the shotgun's accuracy.

It is therefore an object of this invention to provide to a side lock action firearm with an improved stock mounting system that enables the stock to fit flush with a side lock action without backing off or compressing irregularly.

SUMMARY OF THE INVENTION

The present invention provides an improved side lock action firearm, and overcomes the above-mentioned disadvantages and drawbacks of the prior art. As such, the general purpose of the present invention, which will be described subsequently in greater detail, is to provide an improved side lock action firearm that has all the advantages of the prior art mentioned above.

To attain this, the preferred embodiment of the present invention essentially comprises a side lock action firearm having a frame with an attached side lock action. The frame includes a rearwardly protruding portion including a mating feature. A stock including a mating element is removably connected to the frame when the mating element is engaged with the mating feature. The mating feature may be a threaded boss. The mating element may be a draw bolt. A forward portion of the stock may be shaped to closely receive the rearwardly protruding portion of the frame. The stock may include a central bore, and the draw bolt may be received by the central bore in the stock. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 2:
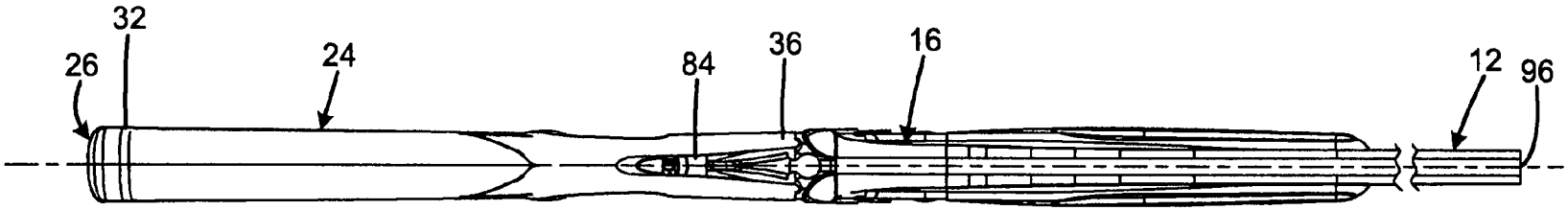
FIG. 2 is a top view of the side lock action firearm of the present invention.

An embodiment of the side lock action firearm of the present invention is shown and generally designated by the reference numeral 10.

FIGS. 1-6 illustrate the side lock action firearm 10 of the present invention. More particularly, the firearm is a shotgun having a frame/receiver 18 that has a front 40, a rear 38, a top 86, and a bottom 88. The front of the receiver receives a monoblock 16. The monoblock 16 attaches an upper barrel tube 12 and a lower barrel tube 14 to the receiver. Each of the barrel tubes has a forward opening or muzzle (96, 98). The rear of the receiver forms an upper tang 84. The upper tang is an elongated protrusion extending generally parallel to the axis of the firearm that forms the top surface of the assembled firearm at that location. The upper tang has an integral post 42 that extends perpendicularly downwards from a lower surface of the upper tang at or near the free end. The center of the post has an elongated threaded boss or rear protrusion 64 that extends rearwardly from a midpoint of the post, making the post T-shaped. The rear protrusion is externally tapered at its rear and has an internally threaded rear bore 62. The rear protrusion is tapered by a limited angle in the range of 10 to 15 degrees included angle, so that a snug fit with a comparably tapered bore in the stock is provided as will be discussed below. The post has a threaded bottom bore 54 opening downwards.

A trigger plate 20 abuts the bottom of the receiver and has a rear 46 and a front 48. The rear of the trigger plate has an aperture 58, and the front of the trigger plate has a slot 60. The bore 58 is located in the trigger plate so that the bore is aligned with the bottom bore in the post when the trigger plate abuts the bottom of the receiver. When connected to the action, the rear of the trigger plate functions as a lower tang that corresponds to the upper tang, and may properly be referred to as such.

A trigger guard 22 abuts the bottom of the trigger plate and has a rear 50 and a front 52. The rear of the trigger guard has an aperture 56, and the front of the trigger guard terminates in a tab that fits into the slot 60 in the front of the trigger plate. The aperture 56 is located in the trigger guard so that the aperture 56 is aligned with both the bottom bore in the post and the aperture 58 in the rear of the trigger plate. A trigger guard screw 72 is inserted through the aperture in the rear of the trigger guard so that the trigger guard screw is received by the bottom bore in the post.

The shotgun also has a stock 24 that has a front 36 and a rear 32. The stock has a central bore 34 that opens both forwardly and rearwardly. The bore has a wider portion 90 that abruptly narrows to a narrower portion 92 about one third of the way from the front of the stock. The rear protrusion of the post 64 mates with the narrow portion of the stock's bore 92 to facilitate alignment of the stock with the receiver. The taper of the rear protrusion facilitates insertion into the narrow portion of the bore. A recoil pad 26 attaches to the rear of the stock and covers the rear opening of the bore during normal operation of the shotgun. The front of the stock is shaped to closely receive the receiver, including the upper tang and the post. The front of the stock is scalloped and includes a bore 44.

Figure 1:
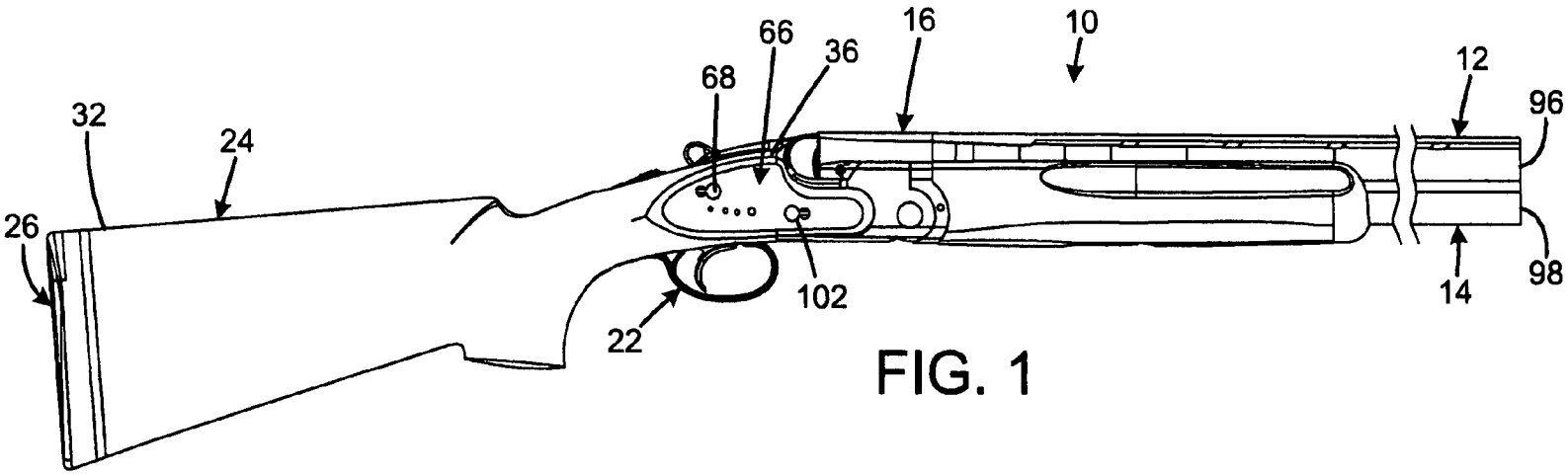
FIG. 1 is a side view of the side lock action firearm of the present invention constructed in accordance with the principles of the present invention.
Figure 3:
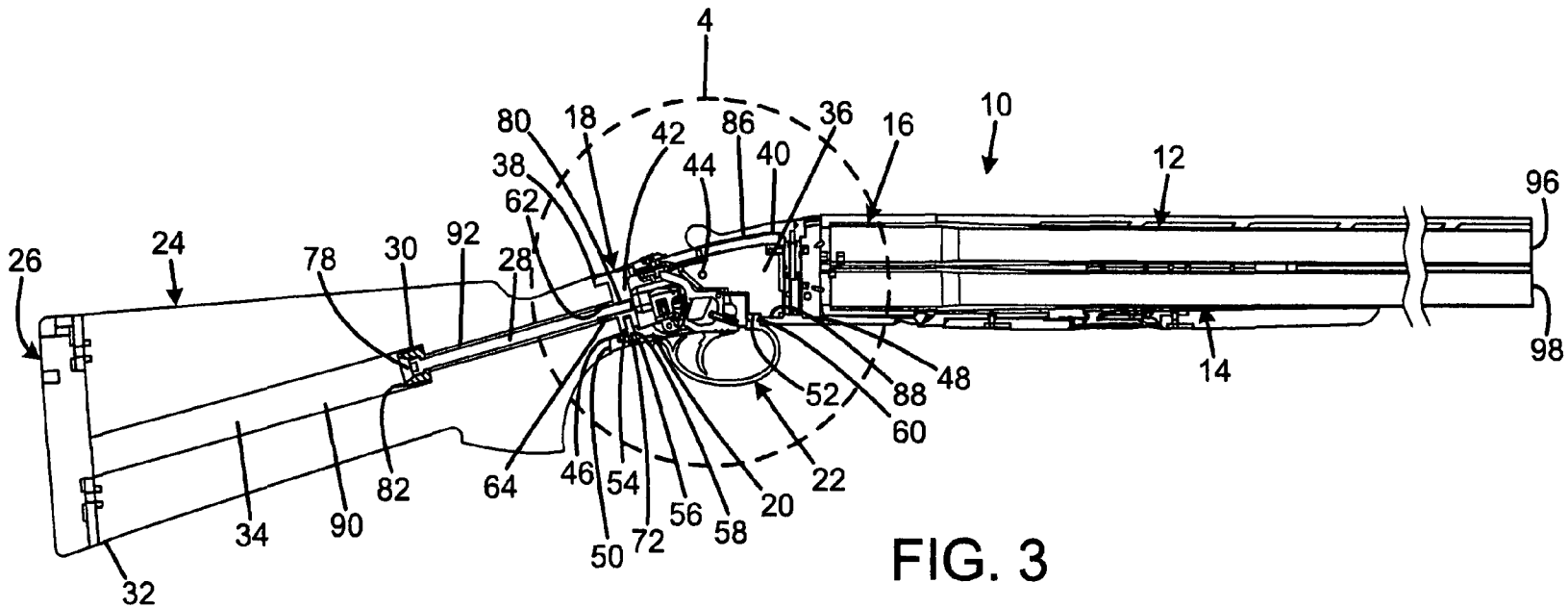
FIG. 3 is a side section view of the side lock action firearm of the present invention.
Figure 4:
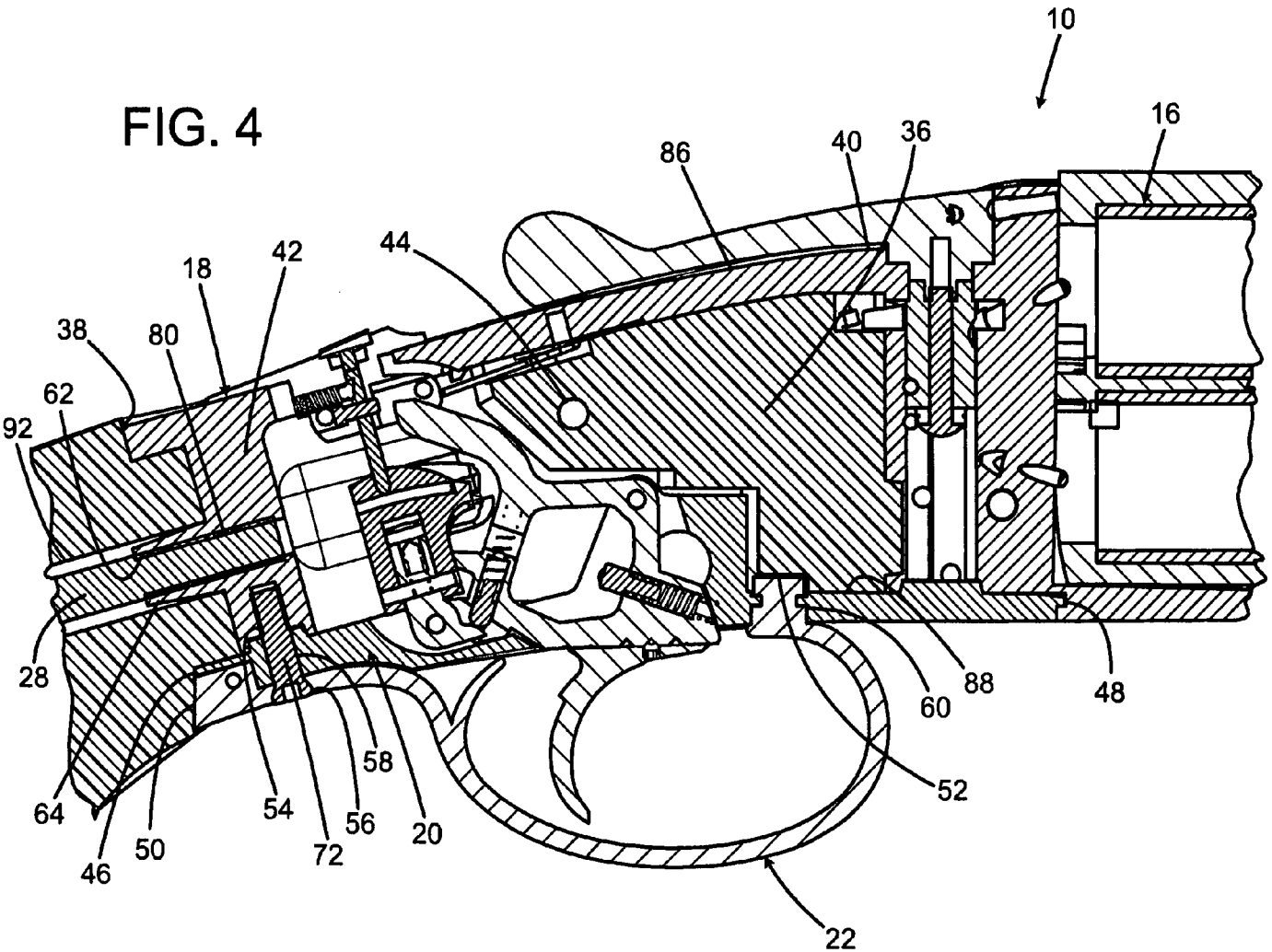
FIG. 4 is a side section view of the side lock action firearm of the present invention showing an enlarged view of the action portion and the forward portion of the stock.
Figure 5:
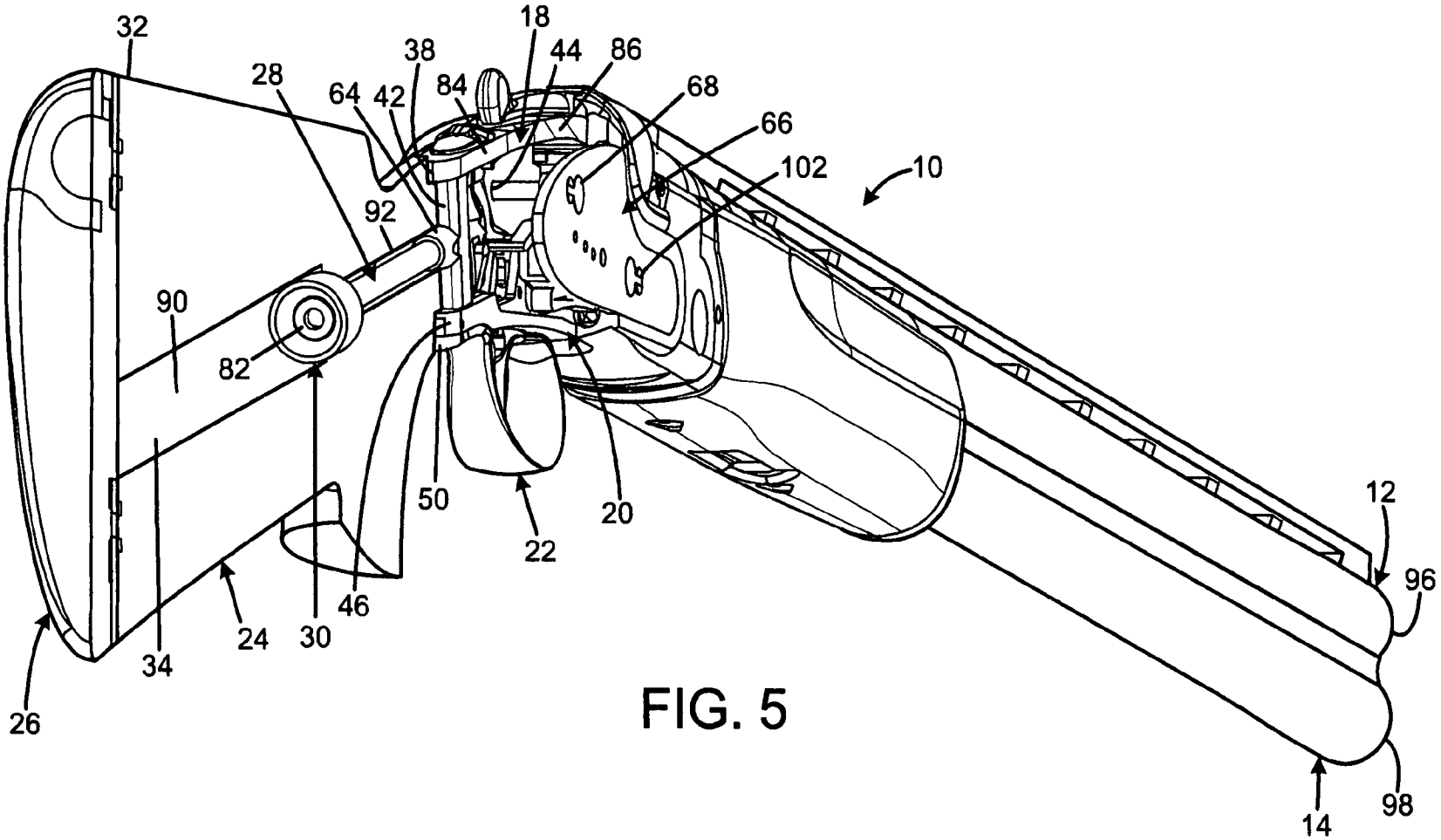
FIG. 5 is a cutaway rear perspective view of the side lock action firearm of the present invention showing a partial side section of the stock and action portions of the side lock action firearm.
Figure 6:
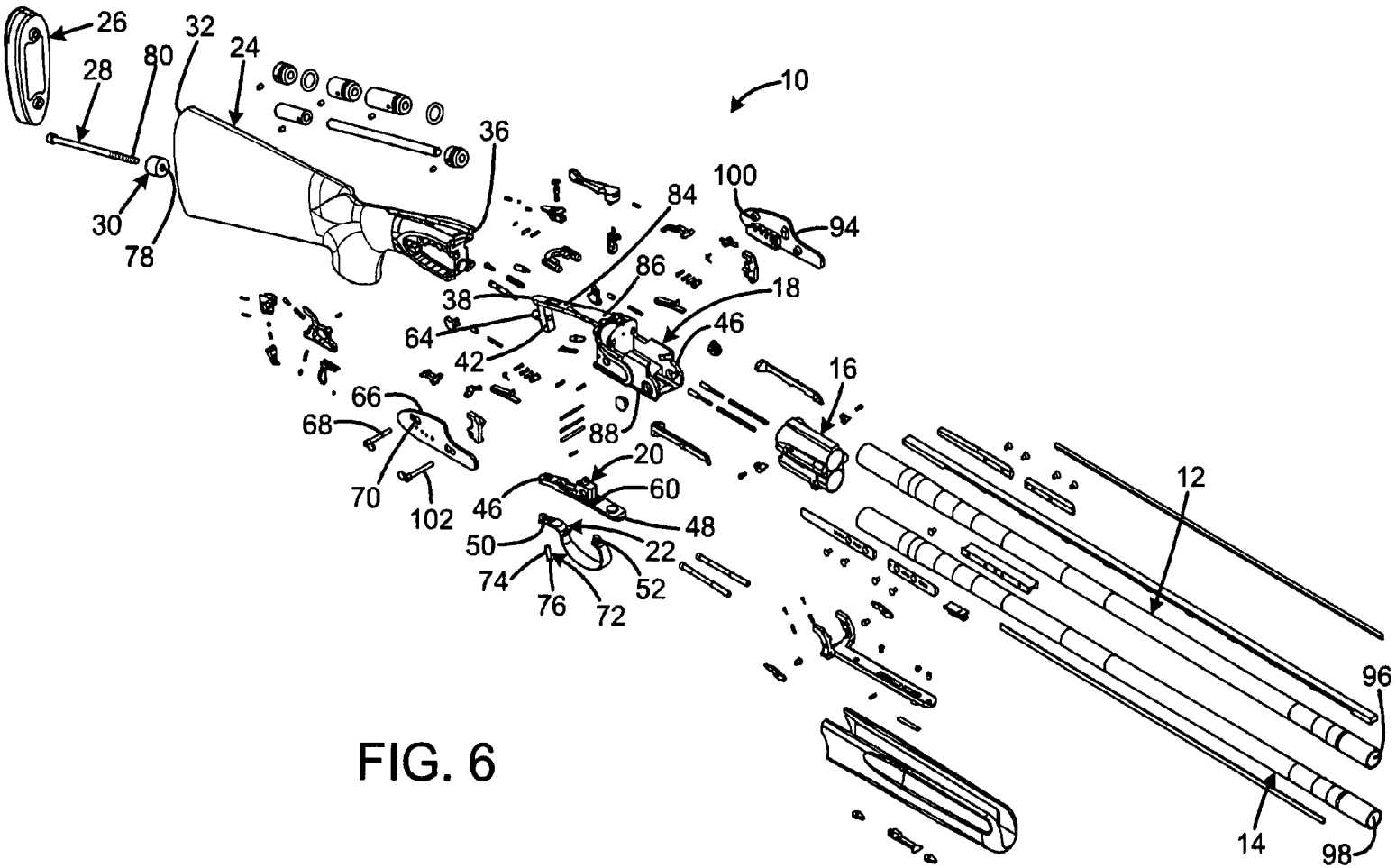
FIG. 6 is an exploded view of the side lock action firearm of the present invention.

In contrast to a conventional side lock action receiver that has an upper tang and a lower tang with screws that extend inward perpendicularly from the ends of the tangs, and which compress the stock between the tangs, the present invention uses a draw bolt similar to a box lock action. However, in contrast to a conventional box lock action stock, the stock extends forward of the post on either side and extends under the tangs well forward of the post. In fact, the wooden stock is visible well forward of the draw bolt's connection to the receiver at the post. This is illustrated in FIGS. 1 and 2, where the front of the stock is visible above and below the right side lock plate 66 and on either side of the upper tang. The front of the stock is also visible on either side of the lower tang. This exposure of the front of the stock imparts the attractive appearance associated with side lock actions to the shotgun of the present invention.

The front of the stock is secured to the rear of the receiver by multiple parts. The draw bolt 28 is inserted threaded end 80 first so that the head 82 of the draw bolt can be retained within the wider portion of the central bore 90 by a draw bolt washer 30. The threaded end 80 extends through the narrower portion of the bore and is received by the threaded rear bore in the rear boss 64. Tightening the draw bolt actually draws the front of the stock forward against the post. Tightening the trigger guard screw secures the trigger guard and trigger plate to the bottom of the receiver and creates a flush fit between the rear of the trigger guard and the front of the stock. The trigger plate/lower tang and upper tang are compressed against the post instead of the front of the stock, which does not experience any vertical compression.

The scalloped front of the stock receives left and right side lock plates (94, 66). The bore in the front of the stock receives a rear side lock plate screw 68. The rear side lock plate screw 68 passes through apertures (70, 100) in the side lock plates and secures the side lock plates to the front of the stock through aperture 44. The forward side lock plate screw 102 secures the side plates to the action. The moving parts of the side lock action are mounted on the side lock plates by pins. The side lock action shotgun of the present invention is similar to conventional side lock action shotguns except for the mounting system that secures the stock 24 to the receiver 18. The moving parts of side lock actions are well known to those skilled in the art, so no further discussion is necessary.

In the context of the specification, the terms "rear" and "rearward" and "front" and "forward" have the following definitions: "rear" or "rearward" means in the direction away from the muzzle of the firearm (which may include extending slightly downward as in the case of the draw bolt) while "front" or "forward" means in the direction towards the muzzle of the firearm; "downward" means in the direction of the bottom of the receiver.

While a current embodiment of the side lock action firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, a post that is a separate element from both tangs, integral to both tangs, is integral to the lower tang, or is connected to only one of the tangs may be used instead of the post integral to the upper tang described. Also, while shotguns as described are the most likely contemplated application for the concepts of the present invention, it should be appreciated that the current invention could be used to for attaching stocks to rifles.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm comprising:

a frame with a forward-extending barrel;

the frame including a pair of spaced apart rearwardly protruding upper and lower tang portions;

a post extending between the tang portions;

the post defining a threaded post bore open in a rearward direction;

a stock adapted to mate with the frame;

wherein the stock extends under the tangs well forward of the post;

the stock defining an elongated bolt bore; and a draw bolt received in the bolt bore and threadably engaged to the post bore.

2. The firearm of claim 1 wherein the post is integral to one of the tangs.

3. The firearm of claim 1 wherein the lower tang comprises part of a trigger plate.

4. The firearm of claim 1 wherein the post is in elongated vertical body with a rearward protrusion extending from an intermediate location on the post, the protrusion forming a threaded boss.

5. The firearm of claim 1 further comprising a side lock action attached to the frame wherein the side lock action compresses the upper tang portion and the lower tang portion against the post.

6. The firearm of claim 1 wherein the firearm is assembled with the stock flush with exposed surfaces of the tangs.

7. The firearm of claim 1 wherein only one of the tangs is integral to the frame.

8. The firearm of claim 1, wherein the stock extends forward of the post on either side.

9. The firearm of claim 5, wherein the stock extends above and below a left side lock plate and a right side lock plate that comprise part of the side lock action.

10. The firearm of claim 1 further comprising the post defining a threaded bore open in a downward direction.

11. The firearm of claim 10 further comprising:

an aperture in the lower tang portion;

the aperture being aligned with the downward threaded bore in the post; and a screw inserted through the aperture in the lower tang portion and received by the downward threaded bore in the post, thereby compressing the upper tang portion and the lower tang portion against the post.

* * * * *